US011506092B2

(12) United States Patent
Van Wingerden et al.

(10) Patent No.: US 11,506,092 B2
(45) **Date of Patent: *Nov. 22, 2022**

(54) ENGINE BRAKE ROCKER ARM HAVING BIASING CONFIGURATION

(71) Applicant: Eaton Intelligent Power Limited, Dublin (IE)

(72) Inventors: Mark Van Wingerden, Battle Creek, MI (US); Matthew Vance, Kalamazoo, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 16/977,857

(22) PCT Filed: Dec. 4, 2018

(86) PCT No.: PCT/US2018/063799

§ 371 (c)(1),
(2) Date: Sep. 3, 2020

(87) PCT Pub. No.: WO2019/113034

PCT Pub. Date: Jun. 13, 2019

(65) Prior Publication Data

US 2021/0040871 A1 Feb. 11, 2021

Related U.S. Application Data

(60) Provisional application No. 62/636,308, filed on Feb. 28, 2018, provisional application No. 62/594,147, filed on Dec. 4, 2017.

(51) Int. Cl.
*F01L 13/06* (2006.01)
*F01L 1/047* (2006.01)
(Continued)

(52) U.S. Cl.
CPC ..... *F01L 13/06* (2013.01); *F01L 1/047* (2013.01); *F01L 1/08* (2013.01); *F01L 1/18* (2013.01);
(Continued)

(58) Field of Classification Search
CPC ..... F01L 1/053; F01L 1/181; F01L 1/2411; F01L 1/26; F01L 1/46; F01L 13/06;
(Continued)

(56) References Cited

U.S. PATENT DOCUMENTS 5,626,116 A * 5/1997 Reedy ..... F01L 1/181 123/321
5,975,251 A 11/1999 McCarthy
(Continued)

FOREIGN PATENT DOCUMENTS

CN 102235202 A 11/2011
CN 102414424 A 4/2012
(Continued)

OTHER PUBLICATIONS

Chinese Office Action for CN Application No. 201780051098.5 dated Jul. 30, 2020.
(Continued)

*Primary Examiner* — Jorge L Leon, Jr.
(74) *Attorney, Agent, or Firm* — Mei & Mark, LLP

(57) ABSTRACT

A rocker arm assembly operable in a first mode and a second mode, the rocker arm assembly selectively opening first and second engine valves based on rotation of a cam shaft having a first cam lobe and a second cam lobe, includes: a rocker shaft; a first rocker arm assembly having a first rocker arm that receives the rocker shaft and rotates around the rocker shaft in the first mode based on engagement with the first cam lobe; a second rocker arm assembly having a second rocker arm that receives the rocker shaft and rotates around
(Continued)

the rocker shaft and selectively act on one of the first and second engine valves in the second mode based on selective engagement with the second cam lobe; and a biasing assembly that cooperates with the second rocker arm to bias the second rocker arm to a neutral position.

20 Claims, 8 Drawing Sheets

(51) Int. Cl.
*F01L 1/08* (2006.01)
*F01L 1/18* (2006.01)
*F01L 1/26* (2006.01)
*F02D 13/04* (2006.01)

(52) U.S. Cl.
CPC ..... *F01L 1/181* (2013.01); *F01L 1/26* (2013.01); *F02D 13/04* (2013.01)

(58) Field of Classification Search
CPC ..... F01L 2760/003; F02D 13/0234; F02D 13/0249; F02D 13/04
USPC ..... 123/90.27, 90.39, 90.4, 90.44, 90.45, 123/90.46
See application file for complete search history.

(56) References Cited

U.S. PATENT DOCUMENTS

| | | | |
|---|---|---|---|
| 6,000,374 | A | 12/1999 | Cosma et al. |
| 6,745,734 | B2 | 6/2004 | Pierik |
| 7,712,449 | B1 | 5/2010 | Schwoerer |
| 8,307,806 | B2 | 11/2012 | Mariano et al. |
| 8,627,791 | B2 | 1/2014 | Janak et al. |
| 8,851,048 | B2 | 10/2014 | Meistrick |
| 9,145,798 | B2 | 9/2015 | Nowak et al. |
| 9,371,780 | B2 | 6/2016 | Toth et al. |
| 9,435,234 | B2 | 9/2016 | Yang |
| 9,822,675 | B2 | 11/2017 | Jeon et al. |
| 10,907,514 | B2 | 2/2021 | Contarin et al. |
| 2003/0154941 | A1 | 8/2003 | Hendriksma |
| 2003/0217715 | A1 | 11/2003 | Pierik |
| 2008/0223325 | A1 | 9/2008 | Meistrick |
| 2010/0108007 | A1 | 5/2010 | Meistrick et al. |
| 2010/0139616 | A1 | 6/2010 | Mariano et al. |
| 2011/0203549 | A1* | 8/2011 | Schnell ..... F01L 1/267 123/322 |
| 2012/0298057 | A1 | 11/2012 | Janak et al. |
| 2013/0269652 | A1 | 10/2013 | Toth et al. |
| 2013/0269653 | A1* | 10/2013 | Yang ..... F01L 1/20 123/323 |
| 2014/0020654 | A1* | 1/2014 | Yang ..... F01L 1/20 123/323 |
| 2014/0109848 | A1 | 4/2014 | Janak et al. |
| 2014/0238015 | A1 | 8/2014 | Roberts et al. |
| 2014/0251266 | A1 | 9/2014 | Emmons et al. |
| 2014/0338622 | A1 | 11/2014 | Flierl et al. |
| 2015/0108383 | A1 | 4/2015 | Nowak et al. |
| 2017/0030231 | A1 | 2/2017 | Jeon et al. |
| 2021/0180475 | A1 | 6/2021 | Contarin et al. |

FOREIGN PATENT DOCUMENTS

| | | | |
|---|---|---|---|
| CN | 103306767 | A | 9/2013 |
| CN | 103328778 | A | 9/2013 |
| CN | 103597174 | A | 2/2014 |
| CN | 104066938 | A | 9/2014 |
| CN | 105089822 | A | 11/2015 |
| CN | 105121090 | A | 12/2015 |
| CN | 107023342 | A | 8/2017 |
| CN | 107143394 | A | 9/2017 |
| EP | 1721069 | B1 | 1/2009 |
| EP | 2715076 | B1 | 4/2016 |
| EP | 3073069 | A1 | 9/2016 |
| JP | 2001289021 | A | 10/2001 |
| WO | 2008091302 | A1 | 7/2008 |
| WO | 2016118548 | A1 | 7/2016 |
| WO | WO 2016118548 | A1 | 7/2016 |
| WO | WO 2017197044 | A1 | 11/2017 |

OTHER PUBLICATIONS

Chinese Office Action for CN Application No. 20188007874098 dated Oct. 19, 2021.
Chinese Office Action for CN Application No. 201880087409.8 dated Oct. 27, 2021.
International Search Report and Written Opinion for International Application No. PCT/EP2017/065667 dated Oct. 30, 2017, 12 pages.
Yang Yunfeng: "Two Kinds of Brakes and Their Adjustment of Shandong 7Y-950A Three-Wheeled Agricultural Transport Vehicle", Agricultural Machinery, issue 7, 2001, p. 62.

* cited by examiner

ENGINE BRAKE ROCKER ARM HAVING BIASING CONFIGURATION

CROSS-REFERENCE TO RELATED APPLICATIONS

This application is a U.S. National Phase application under 35 U.S.C. § 371 of International Application No. PCT/US2018/063799, filed on Dec. 4, 2018, and claims benefit to U.S. Provisional Patent Application No. 62/594,147 filed on Dec. 4, 2017 and U.S. Provisional Patent Application No. 62/636,308 filed on Feb. 28, 2018. The International Application was published in English on Jun. 13, 2019 as WO 2019/113034 under PCT Article 21(2).

FIELD

The present disclosure relates generally to a rocker arm assembly for use in a valve train assembly and more particularly to a rocker arm assembly that incorporates a dedicated rocker arm that acts on a single valve and that incorporates a biasing assembly that biases the rocker arm to a neutral position.

BACKGROUND

Compression engine brakes can be used as auxiliary brakes, in addition to wheel brakes, on relatively large vehicles, for example trucks, powered by heavy or medium duty diesel engines. A compression engine braking system is arranged, when activated, to provide an additional opening of an engine cylinder's exhaust valve when the piston in that cylinder is near a top-dead-center position of its compression stroke so that compressed air can be released through the exhaust valve. This causes the engine to function as a power consuming air compressor which slows the vehicle.

In a typical valve train assembly used with a compression engine brake, the exhaust valve is actuated by a rocker arm which engages the exhaust valve by means of a valve bridge. The rocker arm rocks in response to a cam on a rotating cam shaft and presses down on the valve bridge which itself presses down on the exhaust valve to open it. A hydraulic lash adjuster may also be provided in the valve train assembly to remove any lash or gap that develops between the components in the valve train assembly.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

In an embodiment, the present invention provides a rocker arm assembly operable in a first mode and a second mode, the rocker arm assembly selectively opening first and second engine valves based on rotation of a cam shaft having a first cam lobe and a second cam lobe, the rocker arm assembly comprising: a rocker shaft; a first rocker arm assembly having a first rocker arm that receives the rocker shaft and is configured to rotate around the rocker shaft in the first mode based on engagement with the first cam lobe; a second rocker arm assembly having a second rocker arm that receives the rocker shaft and is configured to rotate around the rocker shaft and selectively act on one of the first and second engine valves in the second mode based on selective engagement with the second cam lobe; and a biasing assembly that cooperates with the second rocker arm to bias the second rocker arm to a neutral position, wherein in the neutral position, the second rocker arm is spaced from contact relative to both of the second cam lobe and the second engine valve.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
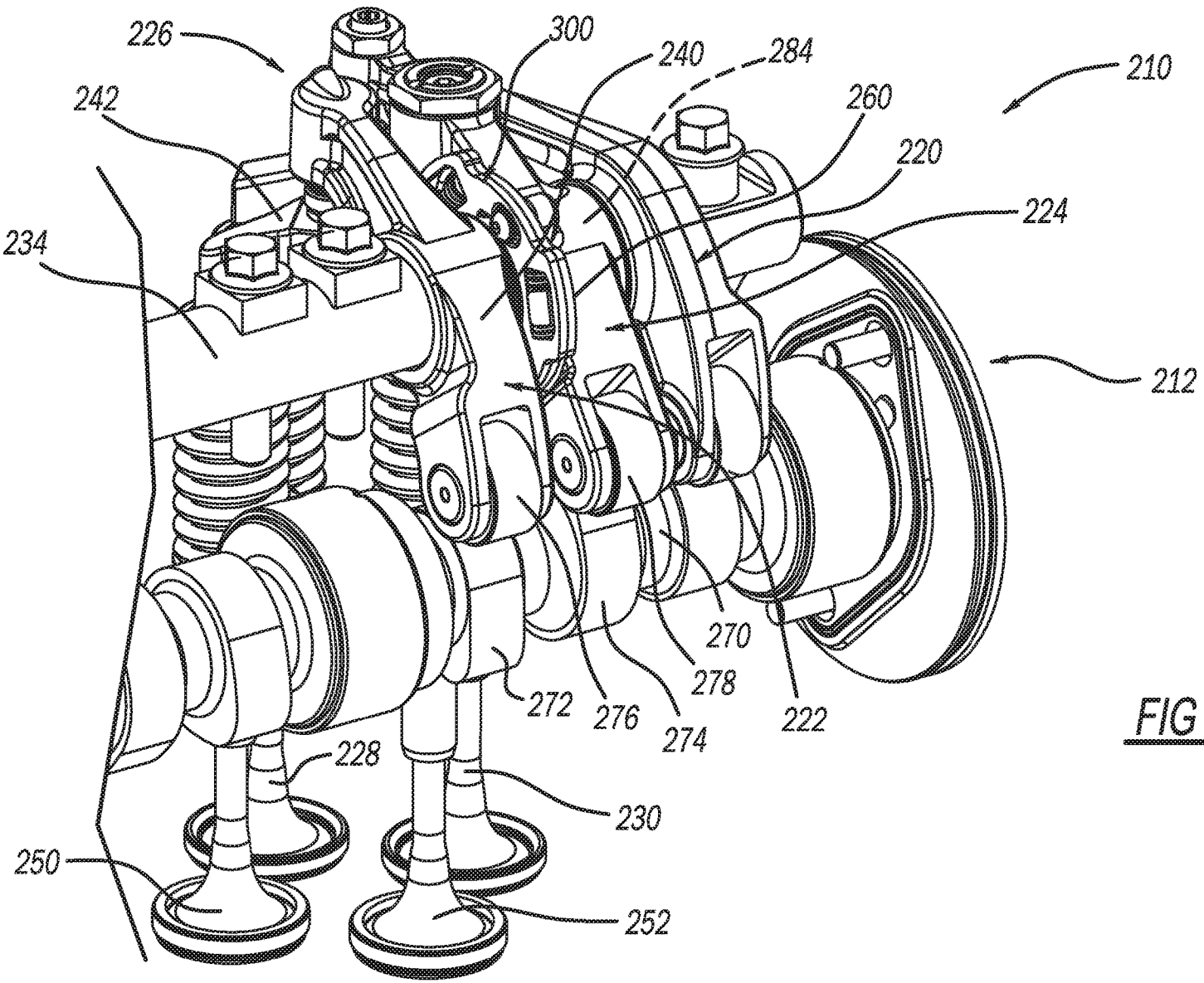
FIG. 1 is a first perspective view of a partial valve train assembly incorporating a rocker arm assembly including an intake rocker arm, an exhaust rocker arm and an engine brake rocker arm having a biasing assembly constructed in accordance to one example of the present disclosure.

A rocker arm assembly operable in a first mode and a second mode selectively opens first and second engine valves based on rotation of a cam shaft having a first cam lobe and a second cam lobe. The rocker arm assembly includes a rocker shaft, a first and second rocker arm assemblies and a biasing assembly. The first rocker arm assembly has a first rocker arm that receives the rocker shaft and is configured to rotate around the rocker shaft in the first mode based on engagement with the first cam lobe. The second rocker arm assembly has a second rocker arm that receives the rocker shaft and is configured to rotate around the rocker shaft and selectively act on one of the first and second engine valves in the second mode based on selective engagement with the second cam lobe. The biasing assembly cooperates with the second rocker arm to bias the second rocker arm to a neutral position. In the neutral position, the second rocker arm is spaced from contact relative to both of the second cam lobe and the second engine valve.

According to other features, the biasing assembly further includes a spring plate assembly having a first spring plate, a second spring plate and at least one biasing member. The first spring plate is fixed relative to the rocker shaft. The second spring plate is fixed for rotation with the second rocker arm. The at least one biasing member is disposed relative to the first and second spring plates and is configured to load and unload based on rotation of the second rocker arm around the rocker shaft. The spring plate assembly can define at least one window that is configured to receive the at least one biasing member. The at least one window is defined in part by a first bearing surface on the first spring plate and a second bearing surface on the second spring plate. The at least one biasing member bears against the respective first and second bearing surfaces during rotation of the second rocker arm around the rocker shaft.

In other features, the spring plate assembly comprises at least one spring retainer configured to retain the at least one biasing member within the at least one window. The first plate can define at least one slot. The second plate can define at least one aperture. A fastener extends through the at least one slot and the at least one aperture and is threadably secured into a threaded bore defined in the second rocker arm. The second spring plate rotates relative to the first spring plate while the fastener travels along the at least one slot during rotation of the second rocker arm during operation in the second mode.

According to additional features, the second rocker arm includes a capsule configured to move between a retracted position and an extended position. In the retracted position, the biasing assembly biases the second rocker arm to the neutral position. In the extended position, the second rocker arm is caused to rotate toward the second cam lobe preloading the biasing assembly.

In additional features, an orientation system can include a key extending from the rocker shaft. A keyway can be defined on the first plate. A pair of opposed stops can define a rotational limitation slot on the second plate. The key is fixed to the first plate at the keyway. Rotation of the second rocker arm is limited by engagement of the key with the opposed stops on the second plate.

In one arrangement, the first rocker arm assembly is an exhaust valve rocker arm assembly and the second rocker arm assembly is an engine brake rocker arm assembly. The exhaust valve rocker arm assembly includes an exhaust rocker arm and a valve bridge. The valve bridge has a lever pivotally coupled thereto such that during operation in the second mode, the engine brake rocker arm does not transfer motion to the valve bridge. In one configuration, the first and second engine valves are exhaust valves and one of the first and second modes includes early exhaust valve opening (EEVO). In another configuration, the first and second engine valves are intake valves and wherein one of the first and second modes includes late intake valve closing (LIVC).

A rocker arm assembly operable in a first mode and a second mode selectively opens first and second engine valves based on rotation of a cam shaft having a first cam lobe and a second cam lobe. The rocker arm assembly includes a rocker shaft, a first and second rocker arm, a capsule and a spring plate assembly. The first rocker arm is configured to rotate around the rocker shaft in the first mode based on engagement with the first cam lobe. The second rocker arm is configured to rotate around the rocker shaft and selectively act on one of the first and second engine valves in the second mode based on selective engagement with the second cam lobe. The capsule is arranged on the second engine brake rocker arm and is configured to move between an extended position and a retracted position. The spring plate assembly cooperates with the second rocker arm to bias the second rocker arm to a neutral position when the capsule is in the retracted position. In the neutral position, the second rocker arm is spaced from contact relative to both of the second cam lobe and the second engine valve. The spring plate assembly includes a first spring plate, a second spring plate and at least one biasing member. The first spring plate is fixed relative to the rocker shaft. The second spring plate is fixed for rotation with the second rocker arm. The at least one biasing member selectively biases against the first and second spring plates upon rotation of the second rocker arm.

The spring plate assembly can define at least one window that is configured to receive the at least one biasing member. The at least one window is defined in part by a first bearing surface on the first spring plate and a second bearing surface on the second spring plate. The at least one biasing member bears against the respective first and second bearing surfaces during rotation of the second rocker arm around the rocker shaft.

In other features, the spring plate assembly comprises at least one spring retainer configured to retain the at least one biasing member within the at least one window. The first plate can define at least one slot. The second plate can define at least one aperture. A fastener extends through the at least one slot and the at least one aperture and is threadably secured into a threaded bore defined in the second rocker arm. The second spring plate rotates relative to the first spring plate while the fastener travels along the at least one slot during rotation of the second rocker arm during operation in the second mode.

In additional features, in the extended position, the second rocker arm is caused to rotate toward the second cam lobe preloading the biasing assembly. An orientation system can include a key extending from the rocker shaft. A keyway can be defined on the first plate. A pair of opposed stops can define a rotational limitation slot on the second plate. The key is fixed to the first plate at the keyway. Rotation of the second rocker arm is limited by engagement of the key with the opposed stops on the second plate.

The following discussion is set forth in the context of rocker arms for opening exhaust valves configured in a compression engine braking system. The discussion focuses on a camshaft having a primary lift cam and an engine brake lift cam. It will be appreciated that the disclosure is not so limited. For example, the present disclosure can also be additionally or alternatively applicable to exhaust valves in other non-compression brake systems. Moreover, the disclosure may also be applicable to intake valves. In this regard, the camshaft can be configured with a primary lift cam and a secondary lift cam. For example, the present disclosure can also be applicable to valvetrains configured for early exhaust valve opening (EEVO), late intake valve closing (LIVC) or other variable valve actuation (VVA) configurations.

Heavy duty (HD) diesel engines with single overhead cam (SOHC) valvetrain requires high braking power, in particular at low engine speed. The present disclosure provides an added motion type de-compression engine brake. To provide high braking power without applying high load on the rest of the valvetrain (particularly the camshaft), the present disclosure provides a dedicated rocker arm for engine brake that acts on one exhaust valve. In this regard, half of the input load is experienced compared to other configurations that have two exhaust valves opening.

With initial reference to FIG. 1, a partial valve train assembly constructed in accordance to one example of the present disclosure is shown and generally identified at reference 210. The partial valve train assembly 210 utilizes engine braking and is shown configured for use in a three-cylinder bank portion of a six-cylinder engine. It will be appreciated however that the present teachings are not so limited. In this regard, the present disclosure may be used in any valve train assembly that utilizes engine braking or other valvetrains such as those discussed above. The partial valve train assembly 210 is supported in a valve train carrier 212 and can include three rocker arms per cylinder.

Specifically, each cylinder includes an intake valve rocker arm assembly 220, an exhaust valve rocker arm assembly 222 and an engine brake rocker arm assembly 224. The exhaust valve rocker arm assembly 222 and the engine brake rocker arm assembly 224 cooperate to control opening of the exhaust valves and are collectively referred to as a dual exhaust valve rocker arm assembly 226. The intake valve rocker arm assembly 220 is configured to control motion of intake valves 228, 230. The exhaust valve rocker arm assembly 222 is configured to control exhaust valve motion in a drive mode. The engine brake rocker arm assembly 224 is configured to act on one of the two exhaust arms in an engine brake mode as will be described herein. A rocker shaft 234 is received by the valve train carrier 212 and supports rotation of the exhaust valve rocker arm assembly 222 and the engine brake rocker arm assembly 224.

Figure 2:
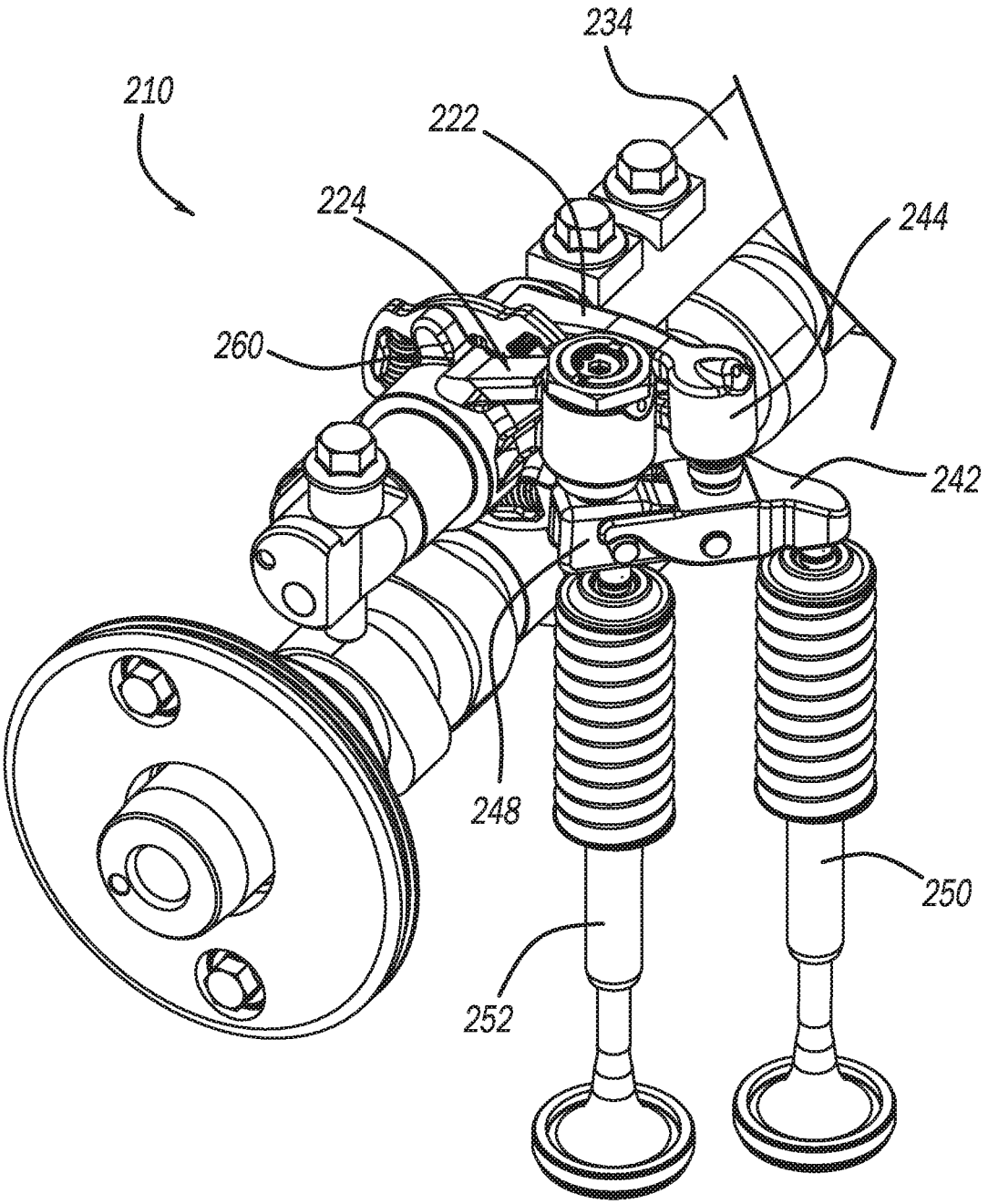
FIG. 2 is a second perspective view of the partial valve train assembly of FIG. 1 and shown with the intake rocker arm and associated intake valves removed for illustrative purposes.
Figure 3:
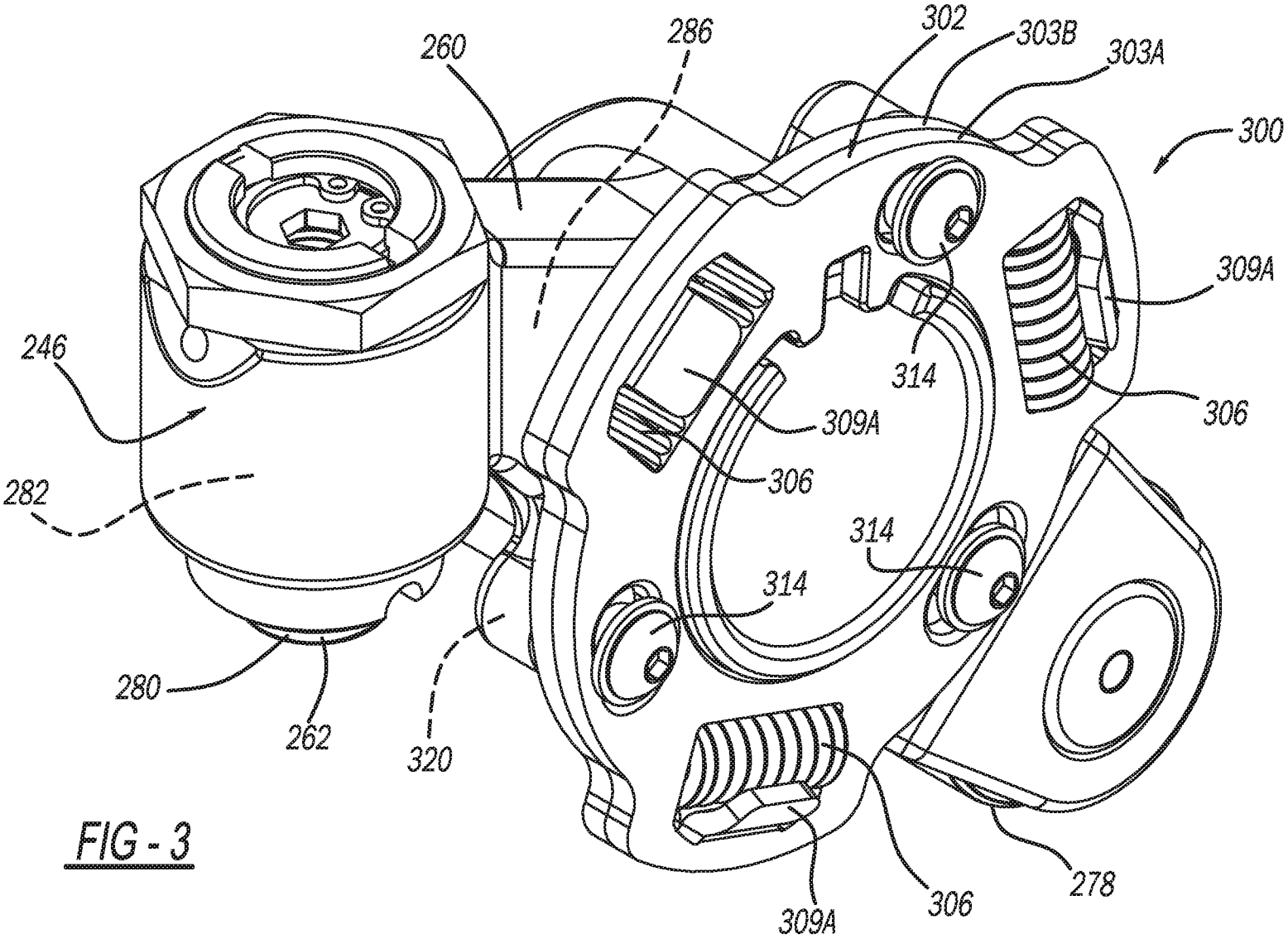
FIG. 3 is a first perspective view of the engine brake rocker arm and associated biasing assembly.

With continued reference to FIG. 1 and additional reference to FIG. 2, the exhaust valve rocker arm assembly 222 can generally include an exhaust rocker arm 240, a valve bridge 242, and a spigot assembly 244. A lever 248 can be pivotably coupled to the valve bridge 242 such that during a braking event an engine brake rocker arm 260 does not transfer motion to the valve bridge 242. The engine brake rocker arm assembly 224 can include the engine brake rocker arm 260 having an engaging portion 262 (FIG. 3). The valve bridge 242 engages a first and second exhaust valve 250 and 252 (FIG. 1) associated with a cylinder of an engine.

A camshaft 270 includes an exhaust main lift cam lobe 272 and an engine brake cam lobe 274. The exhaust rocker arm 240 has a first roller 276. The engine brake rocker arm 260 has a second roller 278. The first roller 276 rotatably engages the exhaust main lift cam lobe 272. As will be described in greater detail herein, the second roller 278 is configured to selectively rotatably engage the engine brake cam lobe 274. The exhaust rocker arm 240 rotates around the rocker shaft 234 based on a lift profile of the exhaust main lift cam lobe 272. The engine brake rocker arm 260 rotates around a rocker shaft 234 based on a lift profile of the engine brake cam lobe 274.

Figure 4:
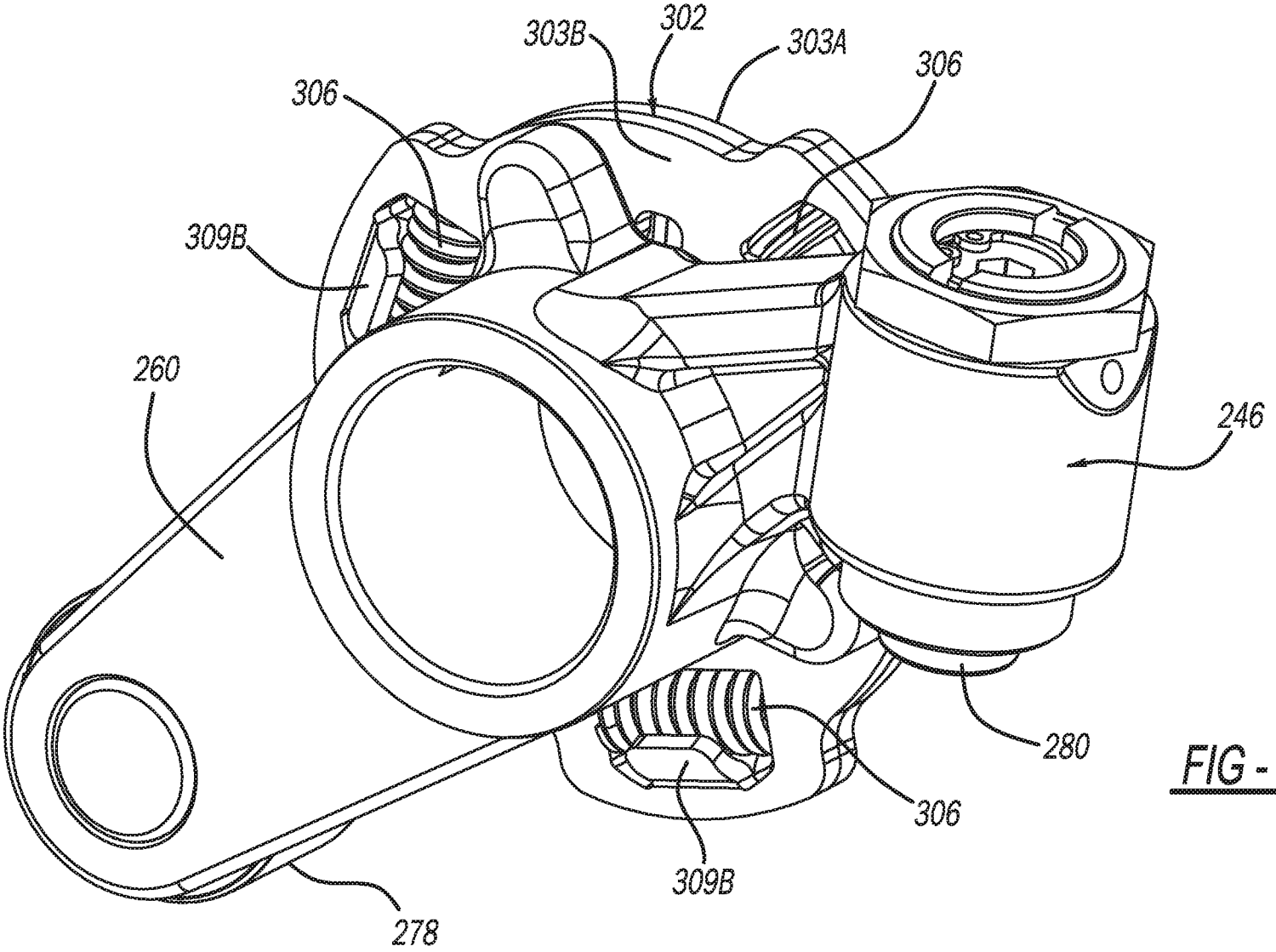
FIG. 4 is a second perspective view of the engine brake rocker arm and associated biasing assembly of FIG. 3.
Figure 5:
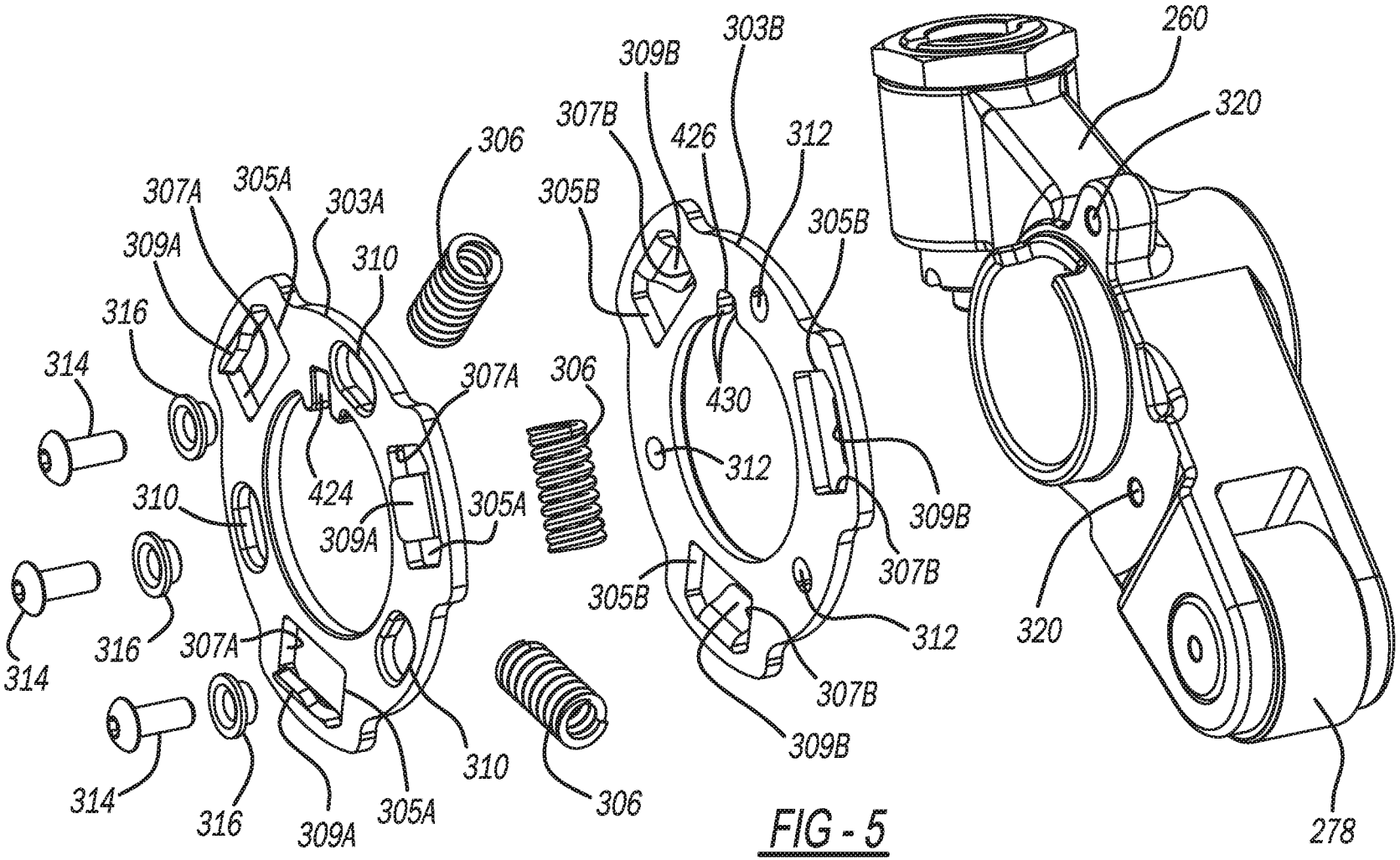
FIG. 5 is an exploded perspective view of the engine brake rocker arm and associated biasing assembly of FIG. 4.

With additional reference now to FIGS. 3-5, the engine brake rocker arm 260 includes an engine brake capsule 246. In general, the engine brake capsule 246 has a plunger 280 that is movably disposed in a cylinder 282. In the example shown, the plunger 280 can include the engaging portion 262. The rocker shaft 234 defines an oil supply channel 284 (FIG. 1). An oil supply passage 286 is defined in the engine brake rocker arm 260. The cylinder 282 can be supplied with pressurized fluid causing the plunger 280 to extend or to retract.

The engine brake rocker arm assembly 224 includes a biasing assembly 300 that cooperates with the engine brake rocker arm 260 to bias the engine brake rocker arm 260 to accommodate mechanical lash. As discussed herein, the biasing assembly 300 biases the engine brake rocker arm 260 to a neutral position out of contact with either the engine brake cam 274 or the valve 252. Moreover, the biasing assembly 300 can be attached to the engine brake rocker arm 260 and installed as a single assembly.

In the example embodiment, the biasing assembly 300 is a spring plate lost motion system that generally includes a spring plate assembly 302 collectively defined in part by first and second spring plates 303A, 303B. The spring plate assembly 302 defines a plurality of windows 304 collectively defined by respective first and second windows 305A, 305B. Each window 304 is configured to receive a biasing member 306 (e.g., a spring). Each of the first windows 305A are partially defined by a first spring bearing surface 307A. Each of the second windows 305B are partially defined by a second spring bearing surface 307B. A plurality of spring retainers 308 (FIG. 6), collectively defined by first fingers 309A (FIG. 5) formed on the first plate 303A and second fingers 309B formed on the second plate 303B are configured to retain the biasing members 306 within the windows 304.

The first plate 303A defines slots 310. The second plate 303B defines apertures 312. Fasteners 314 are configured to pass through respective grommets 316, slots 310, and apertures 312 and threadably secure into respective threaded bores 320 defined in the engine brake rocker arm 260. The second plate 303B is fixed for rotation with the engine brake rocker arm 260. The first plate 303A is fixed to the rocker shaft 234. As will be described herein, when the engine brake rocker arm 260 is caused to rotate around the rocker shaft 234, the biasing members 306 selectively compress and retract..

Figure 6:
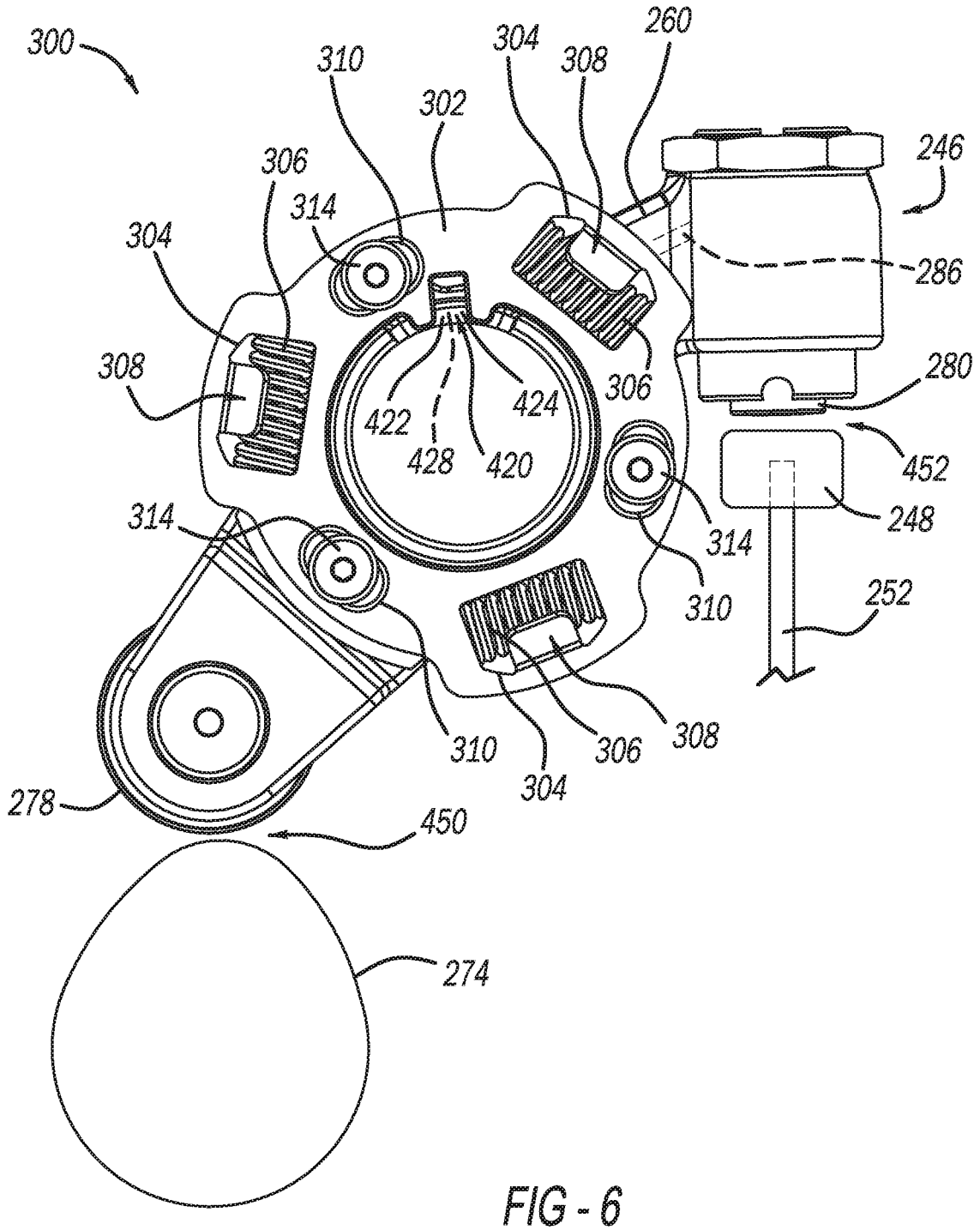
FIG. 6 is a front view of the engine brake rocker arm and biasing assembly of FIG. 3 and shown in a neutral position.
Figure 7:
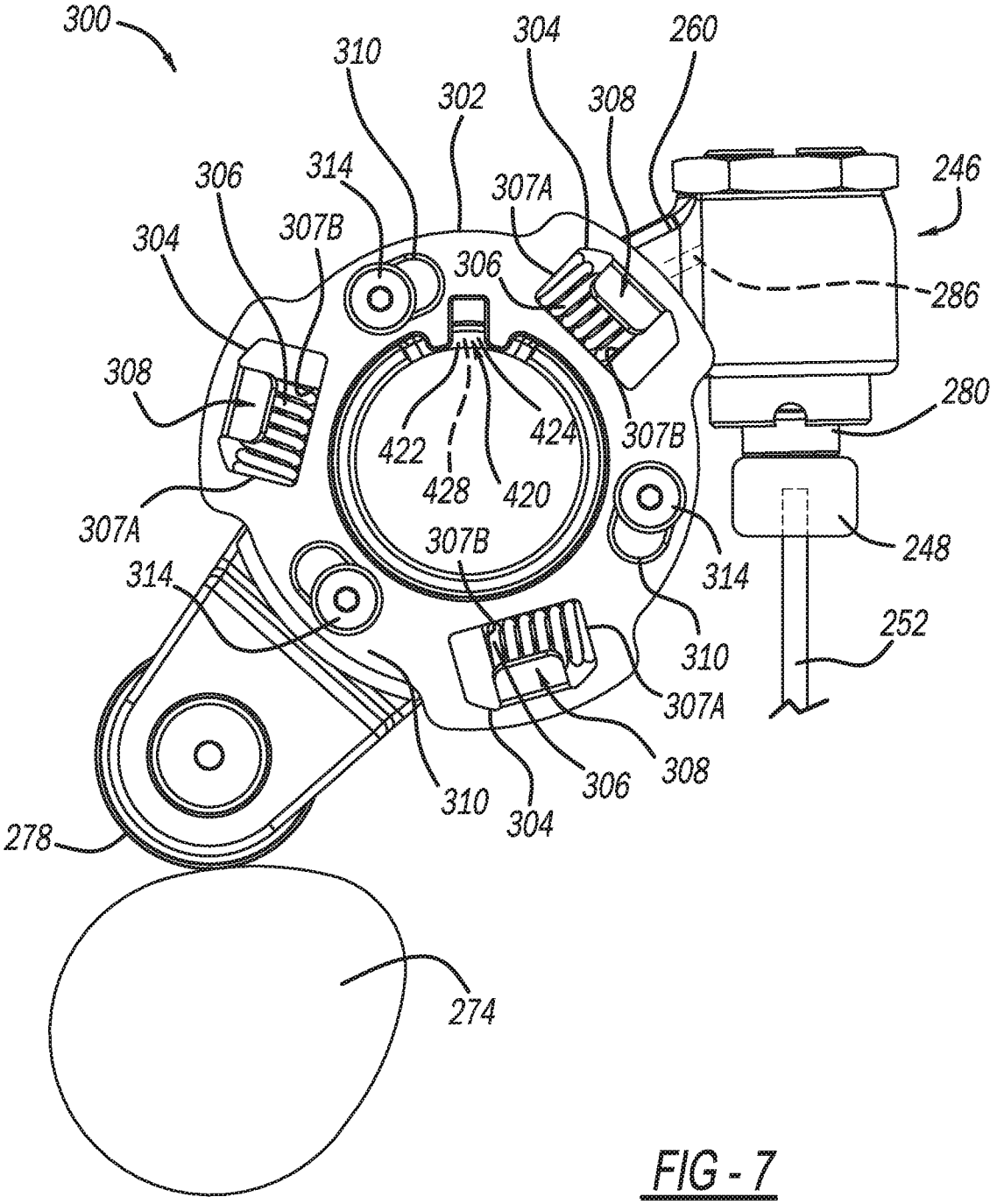
FIG. 7 is a front view of the engine brake rocker arm and biasing assembly of FIG. 3 and shown during an engine braking event wherein biasing members of the biasing assembly are loaded as the rocker arm rotates toward engagement with the engine brake cam lobe.
Figure 8:
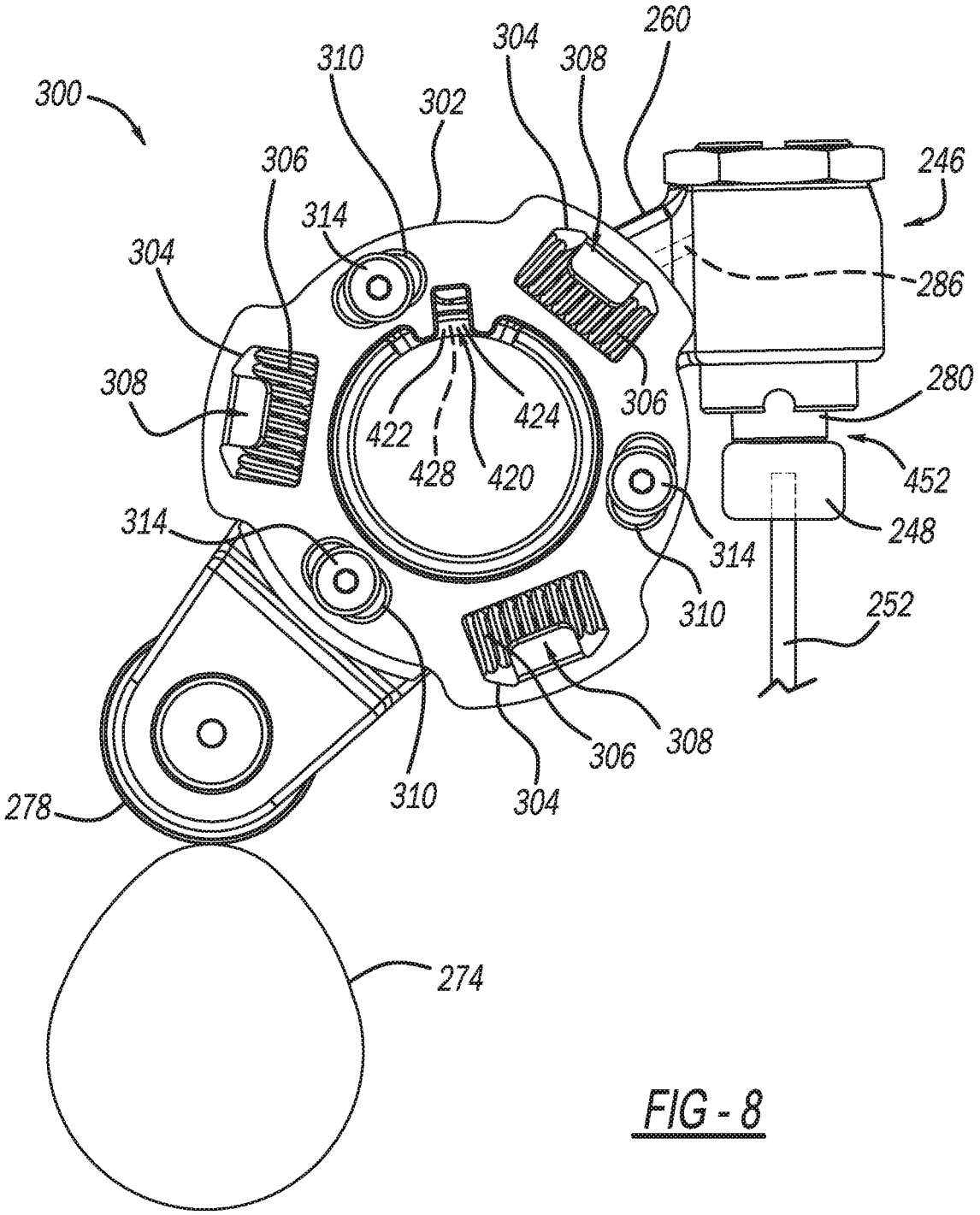
FIG. 8 is a front view of the engine brake rocker arm and biasing assembly of FIG. 7 and shown as the valve goes through a valve lift event and the biasing members become unloaded as the rocker arm rotates clockwise from the position shown in FIG. 7 to the position shown in FIG. 8.

With reference to FIGS. 6-8, an orientation system 420 cooperates with the biasing assembly 300 to hold the engine brake rocker arm 260 neutral in a desired rotational orientation. In the example embodiment, the orientation system 420 includes a key 422, a keyway 424 (FIG. 5) defined on the first plate 303A, and a rotational limitation slot 426 defined on the second plate 303B. As will become appreciated, the orientation system 420 fixes the engine brake rocker arm 360 to the first spring plate 303A.

The key 422 can be coupled to the rocker shaft 234 by inserting a portion of the key 422 into a slot or opening 428 formed in the rocker shaft 234. In some examples, the key 422 is press fit into slot 428 or has a tight clearance fit with the slot 428. In the example illustration, key 422 is a generally semi-circular disc. At least a portion of the key 422 extends outwardly from the outer surface of the rocker shaft 234 when inserted therein. Engine brake rocker arm 260 is configured to receive the rocker shaft 234 such that key 422 is at least partially disposed within the keyway 424 and the rotational limitation slot 426. The key 422 can be configured differently. For example, the key 422 can take other geometrical forms such as, but not limited to, a post that can be press-fit into a complementary bore defined in the rocker shaft 234. Other mechanical features can be incorporated as part of or as a supplemental attachment to the rocker shaft 234 to couple the first spring plate 303A in a fixed orientation relative to the rocker shaft 234. The key 422 fixes the first plate 303A to the rocker shaft 234.

The rotation limitation slot 426 is defined by a pair of opposed stops 430 which are each configured to engage the key 422 to limit the rotational travel of the engine brake rocker arm 260. The rotational limitation slot 426 is defined to provide full design rotation of the engine brake rocker arm 260 without the engine brake rocker arm 260 contacting the key 422. As such, during operation, the rocker shaft 234 and key 422 remain stationary while the engine brake rocker arm 260 selectively rotates about the rocker shaft 234. The stops 430, are positioned to engage key 422 and thus limit rotation of the engine brake rocker arm 260 and facilitate maintaining the engine brake rocker arm 260 in a neutral position.

As mentioned above, the first spring plate 303A remains fixed to the rocker shaft 234. When the brake capsule 246 is "off" or collapsed, the engine brake rocker arm 260 returns to the neutral position such that the second roller 278 is held off the engine brake cam lobe 274. See FIG. 6. Concurrently, the plunger 280 of the brake capsule 246 is held off of the lever 248. In this regard, when the brake capsule 246 is "off" and engine braking is not performed, the engine brake rocker arm 260 is urged to return this neutral position by the biasing assembly 300 whereby the second roller 278 does not engage the engine brake cam lobe 274 on one side and the plunger 280 of the brake capsule 246 does not engage the lever 248 on an opposite side. The neutral position as described herein is used to denote a first non-contact space 450 (FIG. 6) between the engine brake rocker arm 260 and the engine brake cam lobe 274 and a second non-contact space 452 between the engine brake rocker arm 260 and the exhaust valve 252. It is appreciated that the first non-contact space 450 is shown in FIG. 6 specifically between the second roller 278 and the engine brake cam lobe 274. However, the first non-contact space 450 can be defined between any adjacent components intermediate the engine brake rocker arm 260 and the engine brake cam lobe 274. Similarly, while the second non-contact space 452 is shown in FIG. 6 specifically between the lever 248 and the plunger 280, the second non-contact space 252 can be defined between any adjacent components intermediate the engine brake rocker arm 260 and the exhaust valve 252.

During operation, the biasing members 306 hold the engine brake rocker arm 260 in a position relative to the spring plate assembly 302. When the engine brake capsule 246 extends, such as during an engine braking event (FIG. 7), the engine brake rocker arm 260 is caused to rotate in a direction toward the cam (counterclockwise as viewed from FIG. 6 to FIG. 7). The fasteners 314 and grommets 316 travel along the respective slots 310 of the first spring plate 303A. Concurrently, the second spring plate 303B is fixed to the engine brake rocker arm 260. The biasing members 306 become pre-loaded bearing against respective first and second spring bearing surfaces 307A, 307B. As the exhaust valve 252 goes through a valve lift event, the biasing members 306 become unloaded as the engine brake rocker arm rotates (clockwise from FIG. 7 to FIG. 8). The configuration described herein with respect to the biasing assembly 300 is configured to operate opposite to other prior art configurations that rely on valve lift to cause pre-loading of a biasing mechanism.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A rocker arm assembly operable in a first mode and a second mode, the rocker arm assembly selectively opening first and second engine valves based on rotation of a camshaft having a first cam lobe and a second cam lobe, the rocker arm assembly comprising:

a rocker shaft;

a first rocker arm assembly having a first rocker arm that receives the rocker shaft and is configured to rotate around the rocker shaft in the first mode when engaged by the first cam lobe;

a second rocker arm assembly having a second rocker arm that receives the rocker shaft and is configured to rotate around the rocker shaft and selectively act on the second engine valve in the second mode when engaged by the second cam lobe; and a spring plate assembly configured to bias the second rocker arm to a neutral position in which the second rocker arm is spaced away from the second cam lobe and the second engine valve, wherein the spring plate assembly comprises:

a first spring plate fixed to the rocker shaft;

a second spring plate fixed to the second rocker arm; and at least one biasing member disposed between the first spring plate and second spring plates, the at least one biasing member configured to be alternately loaded and unloaded as the second rocker arm rotates around the rocker shaft.

2. The rocker arm assembly of claim 1, wherein the spring plate assembly defines at least one window configured to receive the at least one biasing member.

3. The rocker arm assembly of claim 2, wherein the at least one window is defined by a first bearing surface on the first spring plate and a second bearing surface on the second spring plate, and wherein the at least one biasing member bears against the first and second bearing surfaces as the second rocker arm rotates around the rocker shaft.

4. The rocker arm assembly of claim 2, wherein the spring plate assembly further comprises at least one spring retainer configured to retain the at least one biasing member within the at least one window.

5. The rocker arm assembly of claim 1, wherein the first spring plate defines at least one slot and the second spring plate defines at least one aperture, wherein a fastener extends through the at least one slot and the at least one aperture and is threadably secured into a threaded bore defined in the second rocker arm, and wherein the second spring plate is configured to rotate relative to the first spring plate while the fastener travels along the at least one slot as the second rocker arm rotates around the rocker shaft.

6. The rocker arm assembly of claim 1, wherein the second rocker arm includes a capsule configured to switch between a retracted position and an extended position, and wherein the spring plate assembly is configured to bias the second rocker arm to the neutral position when the capsule is in the retracted position.

7. The rocker arm assembly of claim 6, wherein the second rocker arm rotates toward the second cam lobe so as to preload the spring plate assembly when the capsule is switched to the extended position.

8. The rocker arm assembly of claim 1, further comprising an orientation system comprising:

a key extending from the rocker shaft, a keyway defined on the first spring plate, and a pair of opposed stops defining a rotational limitation slot on the second spring plate, wherein the key is fixed to the first spring plate at the keyway, and wherein rotation of the second rocker arm is limited by an engagement of the key with the opposed stops.

9. The rocker arm assembly of claim 1, wherein the first rocker arm assembly further includes a valve bridge and a lever pivotally coupled to the valve bridge, and wherein the second rocker arm assembly does not transfer motion to the valve bridge when operating in the second mode.

10. The rocker arm assembly of claim 1, wherein the first and second engine valves are exhaust valves, and wherein the second mode includes early exhaust valve opening (EEVO).

11. The rocker arm assembly of claim 1, wherein the first and second engine valves are intake valves, and wherein the second mode includes late intake valve closing (LIVC).

12. A rocker arm assembly operable in a first mode and a second mode, the rocker arm assembly selectively opening first and second engine valves based on rotation of a camshaft having a first cam lobe and a second cam lobe, the rocker arm assembly comprising:

a rocker shaft;

an exhaust rocker arm configured to rotate around the rocker shaft when engaged by the first cam lobe in the first mode;

an engine brake rocker arm configured to rotate around the rocker shaft and selectively act on the second engine valve when engaged by the second cam lobe in the second mode;

a capsule arranged on the engine brake rocker arm, the capsule configured to switch between an extended position and a retracted position; and a spring plate assembly configured to bias the engine brake rocker arm to a neutral position when the capsule is in the retracted position such that the engine brake rocker arm is spaced away from the second cam lobe and the second engine valve, wherein the spring plate assembly comprises:

a first spring plate fixed to the rocker shaft;

a second spring plate fixed to the engine brake rocker arm; and at least one biasing member disposed between the first spring plate and the second spring plate, the at least one biasing member configured to be selectively preloaded against the first and second spring plates upon rotation of the engine brake rocker arm around the rocker shaft.

13. The rocker arm assembly of claim 12, wherein the spring plate assembly defines at least one window configured to receive the at least one biasing member.

14. The rocker arm assembly of claim 13, wherein the at least one window is defined by a first bearing surface on the first spring plate and a second bearing surface on the second spring plate, and wherein the at least one biasing member bears against the first and second bearing surfaces during the rotation of the engine brake rocker arm around the rocker shaft.

15. The rocker arm assembly of claim 14, wherein the spring plate assembly further comprises at least one spring retainer configured to retain the at least one biasing member within the at least one window.

16. The rocker arm assembly of claim 12, wherein the first spring plate defines at least one slot and the second spring plate defines at least one aperture, wherein a fastener extends through the at least one slot and the at least one aperture and is threadably secured into a threaded bore defined in the engine brake rocker arm, and wherein the second spring plate is configured to rotate relative to the first spring plate while the fastener travels along the at least one slot during the rotation of the engine brake rocker arm around the rocker shaft.

17. The rocker arm assembly of claim 12, wherein the engine brake rocker arm rotates toward the second cam lobe so as to preload the spring plate assembly when the capsule is switched to the extended position.

18. The rocker arm assembly of claim 12, further comprising an orientation system comprising:

a key extending from the rocker shaft, a keyway defined on the first spring plate, and a pair of opposed stops defining a rotational limitation slot on the second spring plate, wherein the key is fixed to the first spring plate at the keyway, and wherein rotation of the engine brake rocker arm is limited by an engagement of the key with the opposed stops.

19. A rocker arm assembly operable in a first mode and a second mode, the rocker arm assembly configured to selectively open first and second engine valves, the rocker arm assembly comprising:

a first rocker arm configured to rotate around a rocker shaft in the first mode when engaged by a first cam lobe;

a second rocker arm configured to rotate around the rocker shaft and selectively act on the second engine valve in the second mode when engaged by a second cam lobe; and a spring plate assembly fixed between the rocker shaft and the second rocker arm, the spring plate assembly configured to bias the second rocker arm to a neutral position in which the second rocker arm is spaced away from the second cam lobe and the second engine valve.

20. A rocker arm assembly operable in a first mode and a second mode, the rocker arm assembly configured to selectively open first and second engine valves, the rocker arm assembly comprising:

a rocker shaft;

a first rocker arm configured to rotate around a rocker shaft in the first mode when engaged by a first cam lobe;

a second rocker arm configured to rotate around the rocker shaft and selectively act on the second engine valve in the second mode when engaged by a second cam lobe; and a spring plate assembly comprising:

a first spring plate fixed to the rocker shaft;

a second spring plate fixed to the second rocker arm; and at least one biasing member disposed between the first spring plate and second spring plate.

* * * * *